US011471908B2

(12) United States Patent
Yang et al.

(10) Patent No.: US 11,471,908 B2
(45) Date of Patent: Oct. 18, 2022

(54) SPRAY GUN

(71) Applicant: Zhejiang Prulde Electric Appliance Co., Ltd., Zhejiang (CN)

(72) Inventors: Weiming Yang, Zhejiang (CN); Ting Han, Zhejiang (CN)

(73) Assignee: Zhejiang Prulde Electric Appliance Co., Ltd., Zhejiang (CN)

( * ) Notice: Subject to any disclaimer, the term of this patent is extended or adjusted under 35 U.S.C. 154(b) by 324 days.

(21) Appl. No.: 16/847,686

(22) Filed: Apr. 14, 2020

(65) Prior Publication Data

US 2021/0060594 A1 Mar. 4, 2021

(30) Foreign Application Priority Data

Aug. 30, 2019 (CN) ..... 201910813892.X

(51) Int. Cl.
*B05B 12/08* (2006.01)
*B05B 7/24* (2006.01)

(52) U.S. Cl.
CPC ..... *B05B 12/087* (2013.01); *B05B 7/2416* (2013.01); *B05B 7/2424* (2013.01)

(58) Field of Classification Search
CPC ... B05B 12/087; B05B 7/2416; B05B 7/2424; B05B 9/04; B05B 15/00
USPC ..... 137/53, 472, 485, 469; 251/43, 30.03
See application file for complete search history.

(56) References Cited

U.S. PATENT DOCUMENTS 2,590,656 A * 3/1952 Schnebelverneh ..... F16K 17/04 137/542
9,052,024 B2 * 6/2015 Bertakis ..... F16K 17/0433

FOREIGN PATENT DOCUMENTS

GB 2097896 * 4/1981

* cited by examiner

*Primary Examiner* — Qingzhang Zhou
(74) *Attorney, Agent, or Firm* — JCIP Global Inc.

(57) ABSTRACT

A spray gun includes a machine body, a gun body and a spray cup. A motor is provided in the machine body. A gas exhaust port and a gas intake port communicating with the gun body are provided on a gas outlet passage on the motor. A pressure relief valve is provided at the gas exhaust port and comprises a valve body having a valve cavity. A valve port, a pressure relief port and a mount port communicating with the valve cavity are provided on the valve body. A valve stem and a valve ball rotatable along the valve cavity are provided in the valve cavity. A valve stem spring is provided in the valve cavity to control opening and closing of the gas exhaust port. A gas outlet port is provided on the gas outlet passage. A pressure port is provided on the valve body and communicates with the valve cavity and the gas outlet port.

10 Claims, 4 Drawing Sheets

SPRAY GUN

CROSS-REFERENCE TO RELATED APPLICATION

This application claims the priority benefit of China application serial no. 201910813892 X filed on Aug. 30, 2019. The entirety of the above-mentioned patent application is hereby incorporated by reference herein and made a part of this specification.

BACKGROUND

Technical Field

Embodiments of the present disclosure relate to spray guns, and more particularly relate to a spray gun with improved coating effect.

Description of Related Art

Spray guns are often used for coating walls and floors in home decorations, or coating surfaces of wooden products like furniture, or coating surfaces of art and craft goods. However, common spray guns currently available in the market do not have a pressure relief valve mechanism, thereby causing consequences such as over high motor temperature, undesired atomization effect and reduced service life. Besides, such common spray guns are prone to safety accidents.

Although a pressure relief structure has been equipped for a kind of conventional spray guns, the amount of pressure relief for such pressure relief structures is non-regulatable upon opening and closing the gun body. In this case, when the gun body is closed, pressure in the motor rises, so does the motor temperature simultaneously, which affects the service life of the motor. Also, when the gun is switched on, instantaneous drop of the pressure increases the grain of the sprayed painting, causing an uneven atomization and a poor coating effect.

SUMMARY

An objective of the present disclosure is to provide a spray gun with improved coating effect and a durable service life.

To achieve the objective above, the present disclosure adopts a technical solution as follows. A spray gun includes a machine body, a gun body, and a spray cup. A motor is provided in the machine body for supplying a gas to the gun body. A gas outlet passage is provided on the motor. A gas exhaust port and a gas intake port which communicates with the gun body are provided on the gas outlet passage. A pressure relief valve is provided at the gas exhaust port. The pressure relief valve comprises a valve body having a valve cavity. A valve port, a pressure relief port and a mount port communicating with the valve cavity are provided on the valve body. A valve stem and a valve ball rotatable axially along the valve cavity are provided in the valve cavity. A valve stem spring is provided in the valve cavity for pushing the valve stem to control the valve ball to open and close the gas exhaust port. The valve port is docked to the gas exhaust port. A lock cap for axially retaining the valve stem spring is provided at the mount port. The pressure relief valve further comprises a gas bleed hole communicating with the valve cavity. A gas outlet port is provided on the gas outlet passage. A pressure port in communication with the valve cavity is provided on the valve body. The gas outlet port is arranged in communication with the pressure port.

Further, the valve port and the mount port are arranged along a central axis of the valve body, and the pressure port and the pressure relief port are disposed on a sidewall of the valve body.

Further, the pressure port is disposed above the pressure relief port.

Further, the pressure port is arranged opposite to the pressure relief port; or, the pressure port and the pressure relief port are arranged at a same side.

Further, the pressure relief port is arranged on the sidewall of the valve body proximal to the valve port.

Further, the gas bleed hole is arranged on the lock cap; or, the gas bleed hole is arranged on a sidewall of the valve body above the valve stem.

Further, a retaining ring for radially retaining the valve stem is provided in the valve cavity.

Further, a collar is provided on the valve stem. One end of the valve stem spring abuts against the collar, and the other end of the valve stem spring abuts against the lock cap.

Further, the lock cap is provided with outer thread, and an inner sidewall of the mount port is provided with an inner thread. The outer thread is fitted with the inner thread to fix the lock cap to the mount port. Fitting between the inner thread and the outer thread enables adjustment of a preload force of the valve stem spring.

Further, a mount slot is provided on the gas outlet passage at an outer periphery of the gas exhaust port, and the valve port is sealing-fitted with the mount slot.

With the above technical solutions, the present disclosure offers the following advantages.

1. In the present disclosure, the gas outlet port is arranged on the gas outlet passage, the pressure port communicating with the valve cavity is arranged on the valve body, and the gas outlet port communicates with the pressure port, as such, when the gun body is opened, most of the gas is spurted out from a nozzle at a front end of the gun body, while a small part of the gas is exhausted from the pressure relief port and the gas bleed hole, which guarantees constant stability of the pressure inside the machine. When the gun body is closed, no gas is exhausted from the nozzle at the front end of the gun body, at this time, the pressure inside the gas outlet passage rises, such that one part of the gas pushes the valve ball open via the gas outlet port, and the other part of the gas enters the valve cavity via the gas outlet port and the pressure port to apply an upward pushing force against the valve stem, thereby facilitating pushing against the valve stem. As such, even the valve stem does not further push the valve ball downward, the valve ball can be still easily pushed open, and then the gas will be exhausted from the pressure relief port and the gas bleed hole, that is, the valve ball is opened with a larger stroke, which allows more pressure to be relieved. This not only guarantees the pressure relief effect, but further guarantees that the pressure in the motor does not rise such that the temperature of the motor does not become too high and the service life of the motor is thus extended. Meanwhile, the stable gas pressure inside the motor facilitates coating, such that the liquid as sprayed is uniform and stable without causing an over high instantaneous flowrate, thereby guaranteeing coating effect and quality. Of course, it may also be understood that amplification of pressure relief is attributed to settings of the gas outlet port and the pressure port and the communication therebetween them, that is, auxiliary pushing against the valve stem facilitates pushing the valve ball open. Further, the amount of pressure relief upon closing and opening of the gun body becomes regulatable. Specifically, when the gun body is closed, with the auxiliary pushing against the valve stem via the gas outlet port and the pressure port, the valve ball is pushed open with a larger stroke, which increases the amount of pressure relief, thereby ensuring the pressure relief effect. As such, the gas pressure inside the motor does not rise, the temperature of the motor does not become too high, and the service life of the motor is thus extended. When the gun body is opened, the amount of pressure relief decreases, such that the gas pressure inside the motor is sufficient and stable to ensure coating effect. Finally, by arranging the gas bleed hole communicating with the valve cavity, the gas entering above the valve stem can be smoothly exhausted from the gas bleed hole, without being trapped to react against the valve stem to cause the valve ball unable to be pushed open, thereby guaranteeing that the valve ball can be normally pushed open.

2. By arranging the valve port and the mount port along the central axis of the valve body and arranging the pressure port and the pressure relief port on the sidewall of the valve body, it not only facilitates installation and fixation of the pressure relief valve, but also enables mutual independence between respective ports such that the ports do not interfere with each other during working. Besides, such arrangements enable the respective ports to work together for a better pressure relief and meanwhile guarantee a constant pressure in the gun body so as to guarantee the coating effect.

3. By arranging the pressure port above the pressure relief port, it may facilitate the gas diverted from the gas outlet port to smoothly enter the pressure port, and it also facilitates pushing against the valve stem to open the valve ball with a larger stroke. As such, it may be well guaranteed that when the gun body is closed, the gas pressure in the motor can be smoothly relieved without being accumulated in the motor to burn the motor due to over high temperature, thereby extending the service life of the motor.

4. By arranging the pressure port opposite to the pressure relief port, i.e., the pressure port is arranged in stagger with the pressure relief port, pressurization and pressure relief do not interfere with each other. This not only facilitates pushing against the valve stem, but also guarantees an improved pressure relief effect. Or, the pressure port and the pressure relief port are arranged in a same side, which may also facilitate pushing against the valve stem and meanwhile achieve an improved pressure relief effect.

5. By arranging the pressure relief port on the sidewall of the valve body proximal to the valve port, after the valve ball is pushed open from the gas discharge port, the gas may be timely relieved from the pressure relief port, i.e., relieved at first time, which enhances the promptness of pressure relief and guarantees the pressure relief effect.

6. The gas bleed hole is arranged on the lock cap. Because the lock cap is exactly disposed above the valve stem, the gas entering above the valve stem can be exhausted smoothly and rapidly; meanwhile such an arrangement is convenient, is easy to manufacture, and does not affect other components. Or, the gas bleed hole may be arranged on the sidewall of the valve body above the valve stem, which may well guarantee normal exhaust of the gas entering above the valve stem, thereby guaranteeing that the valve ball can be pushed open normally.

7. The retaining ring that radially retains the valve stem is provided in the valve cavity, which well guarantees that the valve stem does not have a radial offset when making an axial movement so as to guarantee stability and reliability of the axial movement of valve stem. Besides, the retaining ring further plays a role of isolating the pressure relief port from the pressure port, thereby guaranteeing a pressurization effect and a pressure relief effect.

8. The collar is provided on the valve stem, with one end of the valve stem spring abutting against the collar and the other end thereof abutting against the lock cap. Such an arrangement may well guarantee stability and reliability of the valve stem spring upon occurrence of deformation. In other words, when the valve stem spring is compressed or released, the action of the valve stem spring upon the valve stem may be well guaranteed.

9. Fitting between the inner and outer threads can significantly facilitate the connection and fixation between the lock cap and the mount port; meanwhile, the fitting between the inner and outer threads may facilitate adjustment of the lock cap so as to realize adjustment of the spring preload force of the valve stem spring, thereby facilitating control of the pressure upon pressure relief.

10. The mount slot is provided on the gas outlet passage at the outer periphery of the gas exhaust port, and the valve port is sealing-fitted with the mount slot. This not only facilitates the connection between the valve body and the gas outlet passage, but also may ensure non-leakage of the gas, thereby guaranteeing the pressure relief effect.

11. A gas outlet tube connector is provided at the gas outlet port, and a pressure tube connector is provided at the pressure port, the gas outlet tube connector communicating with the pressure tube connector via a gas tube. Such an arrangement greatly facilitates communication between the gas outlet port and the pressure port, with reliable connection and leakage proof.

To make the aforementioned more comprehensible, several embodiments accompanied with drawings are described in detail as follows.

BRIEF DESCRIPTION OF THE DRAWINGS

Hereinafter, the present disclosure will be further illustrated with reference to the accompanying drawings.

DESCRIPTION OF THE EMBODIMENTS

Hereinafter, the present disclosure will be described in further detail with reference to the accompanying drawings and the embodiments. It needs to be understood that the oriental or positional relationships indicated by the terms "upper," "lower," "left," "right," "longitudinal," "transverse," "inner," "outer," "vertical," "horizontal," "top," "bottom," etc. are oriental and positional relationships only based on the drawings, which are intended only for facilitating or simplifying description of the present disclosure, not for indicating or implying that the devices/elements have to possess those specific orientations or have to be configured and operated with those specific orientations; therefore, they should not be understood as limitations to the present disclosure.

Figure 1:
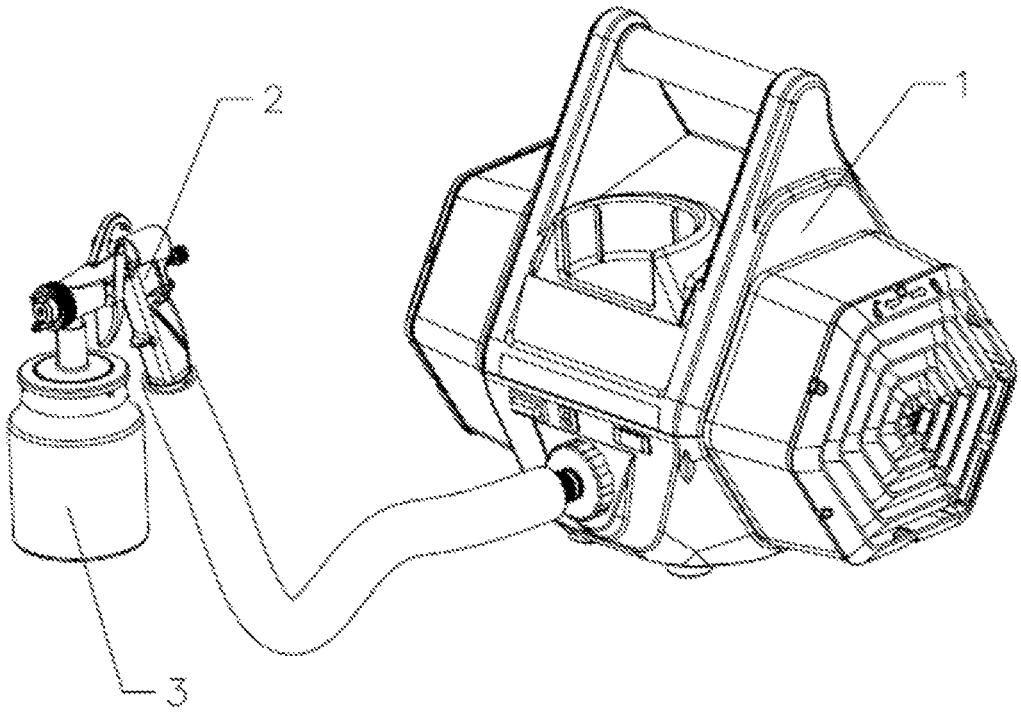
FIG. 1 is a structural schematic diagram of a spray gun according to the present disclosure.
Figure 2:
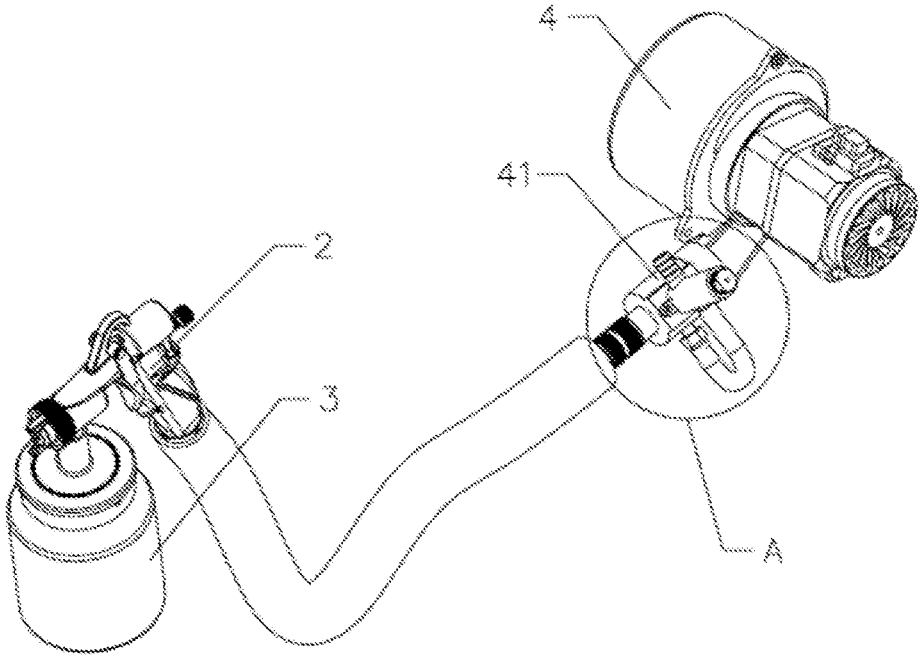
FIG. 2 is a structural schematic diagram of a connection between a motor and a gun body in the spray gun according to the present disclosure.
Figure 3:
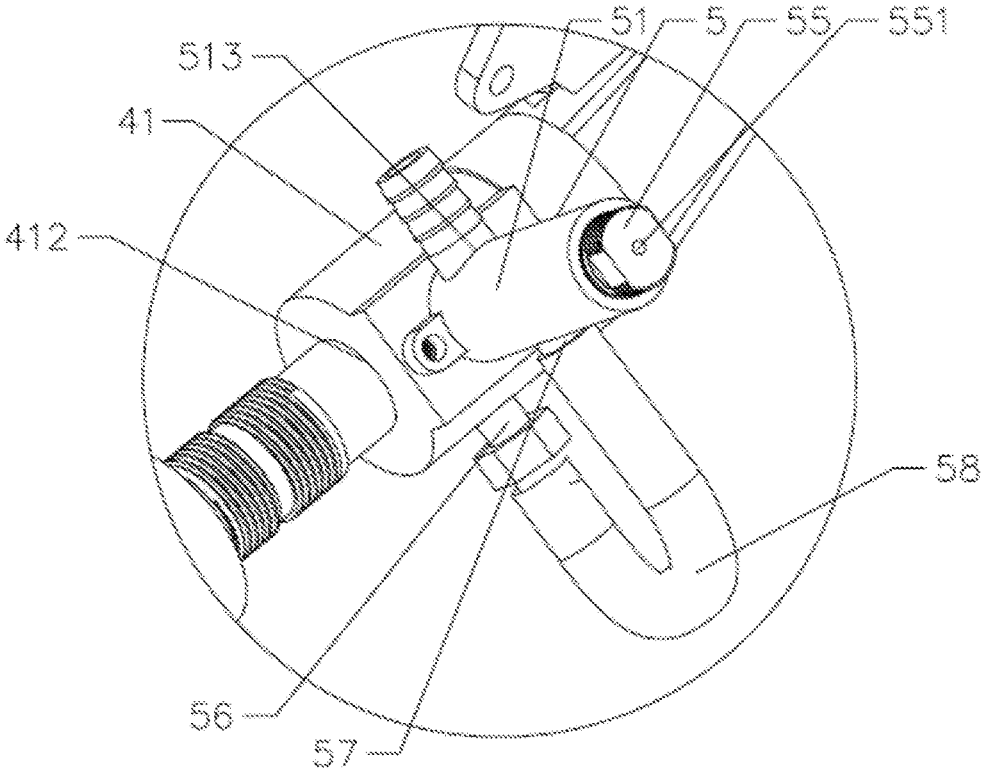
FIG. 3 is an enlarged view of an area A in FIG. 2.
Figure 4:
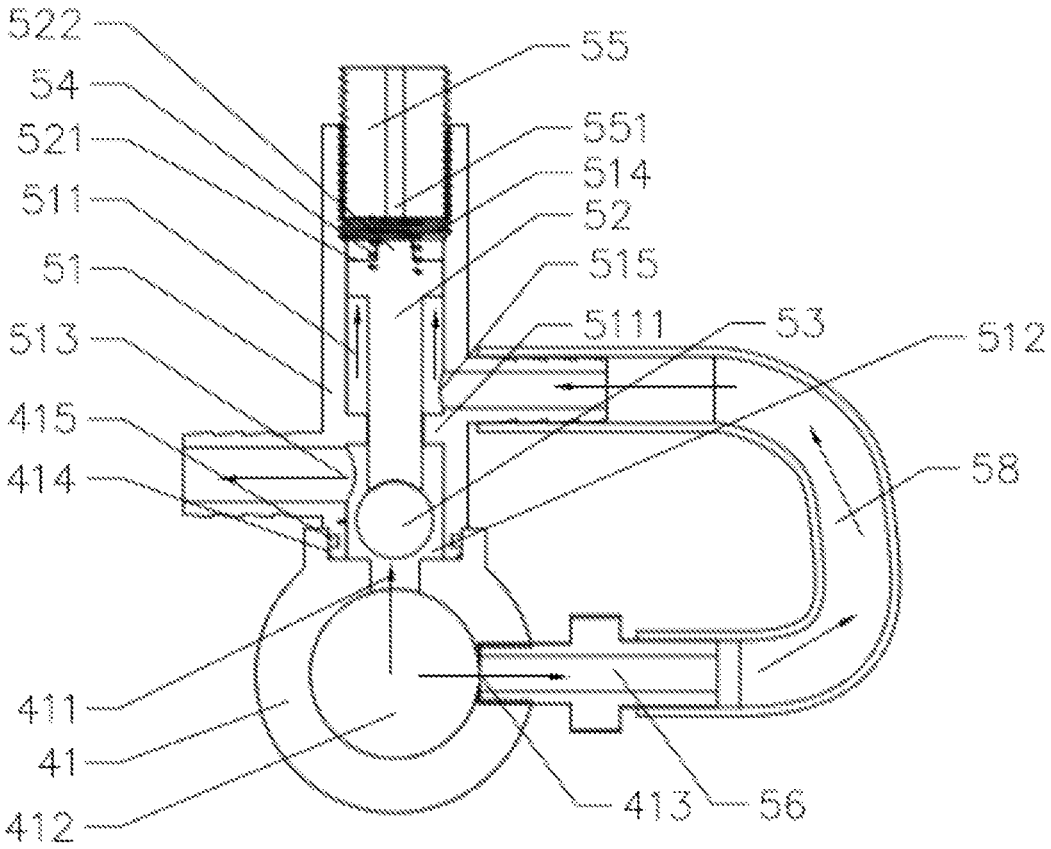
FIG. 4 is a schematic diagram of a state of a pressure relief valve when the gun body of the spray gun is closed according to the present disclosure.
Figure 5:
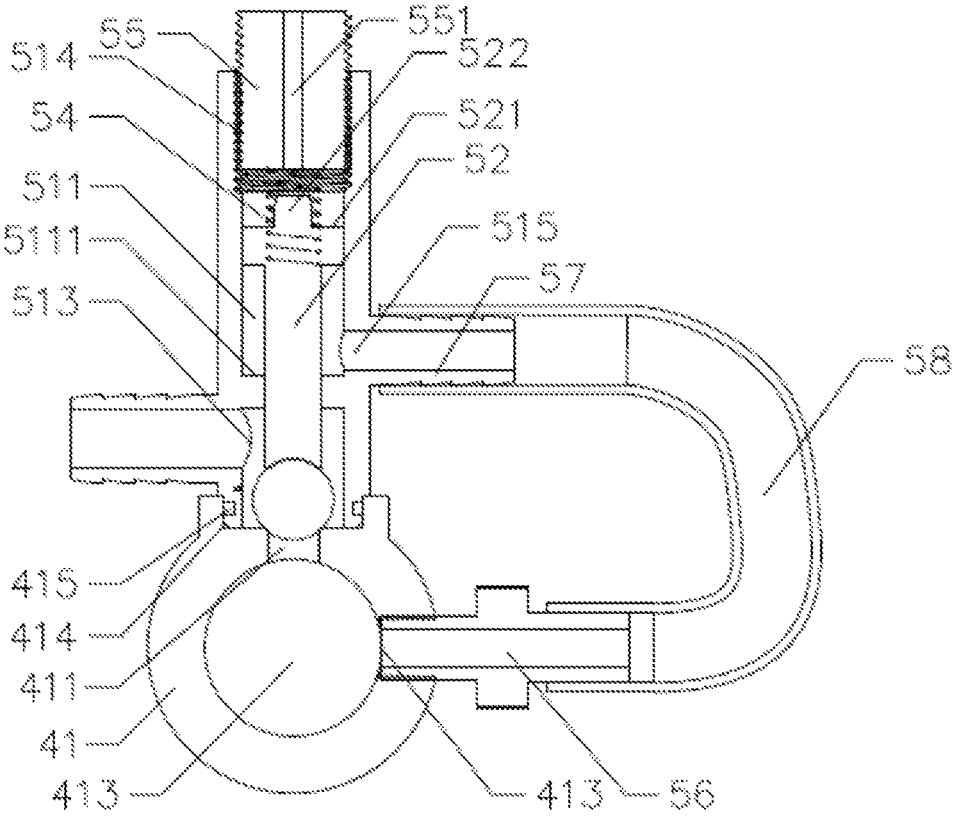
FIG. 5 is a schematic diagram of a state of the pressure relief valve when the gun body of the spray gun is opened according to the present disclosure.

As shown in FIG. 1 to FIG. 5, the present disclosure provides a spray gun with improved coating effect. The spray gun includes a machine body 1, a gun body 2, and a spray cup 3. A motor 4 is provided in the machine body 1 for supplying a gas to the gun body 2, a gas outlet passage 41 is provided on the motor 4, a gas exhaust port 411 and a gas intake port 412 which communicates with the gun body 2 are provided on the gas outlet passage 41, a pressure relief valve 5 is provided at the gas exhaust port 411.

In this embodiment, the pressure relief valve 5 comprises a valve body 51 having a valve cavity 511. A valve port 512, a pressure relief port 513 and a mount port 514 communicating with the valve cavity 511 are provided on the valve body 51. A valve stem 52 and a valve ball 53, which may rotate axially along the valve cavity 511, are provided in the valve cavity 511. A valve stem spring 54 which pushes the valve stem 52 to control the valve ball 53 to open and close the gas exhaust port 411 is provided in the valve cavity 511. The valve port 512 is docked to the gas exhaust port 411. A lock cap 55 for axially retaining the valve stem spring 54 is provided at the mount port 514. The pressure relief valve 5 further comprises a gas bleed hole 551 communicating with the valve cavity 511, which guarantees that the gas entering above the valve stem can be smoothly exhausted from the gas bleed hole, without being trapped to react against the valve stem to cause the valve ball unable to be pushed open, thereby guaranteeing that the valve ball can be normally pushed open. A gas outlet port 413 is provided on the gas outlet passage 41. A pressure port 515 in communication with the valve cavity 511 is provided on the valve body 51. The gas outlet port 413 is arranged in communication with the pressure port 515. As such, when the gun body is opened, most of the gas is spurted out from a nozzle at the front end of the gun body, while a small part of the gas is exhausted from the pressure relief port and the gas bleed hole, which guarantees constant stability of the pressure inside the machine. When the gun body is closed, no gas is exhausted from the nozzle at the front end of the gun body, when the pressure inside the gas outlet passage rises, such that one part of the gas pushes the valve ball open via the gas outlet port and the other part of the gas enters the valve cavity via the gas outlet port and the pressure port to apply an upward pushing force against the valve stem, thereby facilitating pushing against the valve stem. In this case, even the valve stem does not further push downward the valve ball, the valve ball can be still easily pushed open, and then the gas will be exhausted from the pressure relief port and the gas bleed hole, that is, the valve ball is opened with a larger stroke, which allows more pressure to be relieved. This not only guarantees the pressure relief effect, but further guarantees that the pressure in the motor does not rise such that the temperature of the motor does not become too high and the service life of the motor is thus extended. Meanwhile, the stable gas pressure inside the motor facilitates coating, such that the liquid as sprayed is uniform and stable, without an over high instantaneous flowrate, which thereby guarantees coating effect and quality. Of course, it may also be understood that amplification of pressure relief is attributed to settings of the gas outlet port and the pressure port and the communication therebetween, that is, auxiliary pushing against the valve stem facilitates pushing the valve ball open. Further, the amount of pressure relief upon closing and opening of the gun body becomes regulatable. Specifically, when the gun body is closed, with the auxiliary pushing against the valve stem via the gas outlet port and the pressure port, the valve ball is pushed open with a larger stroke, which increases the amount of pressure relief, thereby ensuring the pressure relief effect. As such, the gas pressure inside the motor does not rise, the temperature of the motor does not become too high, and the service life of the motor is thus extended. When the gun body is opened, the amount of pressure relief decreases, which guarantees that the gas pressure in the motor is enough and stable, thereby ensuring the coating effect.

Specifically, the valve port 512 and the mount port 514 are arranged along a central axis of the valve body 51, that is, the central axis of the valve port 512 and the central axis of the mount port 514 coincide with a central axis of the valve cavity 511. In other words, the valve port 512, the mount port 514 and the valve cavity 511 are arranged to communicate directly with each other. Further, arranging the pressure port 515 and the pressure relief port 513 on a sidewall of the valve body 51 may also be understood either as being disposed on a sidewall of the valve cavity 511 or as being arranged horizontally. If the valve port 512 and the mount port 514 are understood as being arranged longitudinally, then the pressure port 515 and the pressure relief port 513 are arranged transversely with their central axes being vertically intersected. This not only facilitates mount and fixation of the pressure relief valve, but also enables mutual independence between respective ports such that they do not interfere with each other during working. Besides, such arrangements enable the respective ports to work together for a better pressure relief and meanwhile guarantee a constant pressure in the gun body so as to guarantee the coating effect.

Moreover, the pressure port 515 is arranged above the pressure relief port 513, which may facilitate the gas diverted from the gas outlet port to smoothly enter from the pressure port. Besides, it also facilitates pushing against the valve stem to open the valve ball with a larger stroke. As such, it may be well guaranteed that when the gun body is closed, the gas pressure in the motor can be smoothly relieved without being accumulated in the motor to burn the motor due to over high temperature, thereby extending the service life of the motor. Meanwhile, more specifically, the pressure port 515 is arranged opposite to the pressure relief port 513, that is, the pressure port is arranged in stagger with the pressure relief port, pressurization and pressure relief do not interfere with each other. This not only facilitates pushing against the valve stem, but also guarantees the pressure relief effect.

Further, by arranging the pressure relief port 513 on a sidewall of the valve body 51 proximal to the valve port 512, after the valve ball is pushed open from the gas discharge port, the gas may be timely relieved from the pressure relief port, i.e., relieved at first time, which enhances the promptness of pressure relief and guarantees the pressure relief effect.

To facilitate the communication between the gas outlet port and the pressure port, a gas outlet tube connector 56 may be provided at the gas outlet port 413, and a pressure tube connector 57 may be provided at the pressure port 515. The gas outlet tube connector 56 communicates with the pressure tube connector 57 via a gas tube 58, and the gas tube 58 is configured as a hose. Such arrangement greatly facilitates communication between the gas outlet port and the pressure port, with reliable connection and leakage proof.

To offer a better gas relief so as to guarantee that the valve ball can be pushed open, the gas bleed hole 551 may be arranged on the lock cap. Because the lock cap is exactly disposed above the valve stem, the gas entering above the valve stem can be exhausted smoothly and rapidly; meanwhile such an arrangement is convenient, is easy to manufacture, and does not affect other components.

To guarantee stability of axial movement of the valve stem, a retaining ring 5111 that radially retains the valve stem 52 may be provided in the valve cavity, which well guarantees that the valve stem does not have a radial offset when making an axial movement so as to guarantee stability and reliability of the axial movement of valve stem. Besides, the retaining ring further plays a role of isolating the pressure relief port from the pressure port, thereby guaranteeing a pressurization effect and a pressure relief effect.

To guarantee stability of the valve stem spring during operating, a collar 521 may be provided on the valve stem 52, and the valve stem spring 54 is sleeved on the valve stem 52. Specifically, a limit boss 522 is disposed at a top end of the valve stem 52. The limit boss 522 is disposed above the collar 521, and the valve stem spring 54 is sleeved on the limit boss 522. In this way, the valve stem spring 54 is radially limited. Of course, to save the manufacturing cost, a diameter of the limit boss 522 is smaller than that of the valve stem 52. As such, one end of the valve stem spring 51 abuts against the collar 521, and the other end of the valve stem spring 51 abuts against the lock cap 55. This arrangement may well guarantee stability and reliability of the valve stem spring upon occurrence of deformation. In other words, when the valve stem spring is compressed or released, the action of the valve stem spring upon the valve stem may be well guaranteed.

To facilitate connection and fixation of the lock cap and to enable control of the pressure upon pressure relief, the lock cap 55 may be provided with an outer thread, and an inner sidewall of the mount port 514 is provided with an inner thread. The outer thread is fitted with the inner thread to fix the lock cap 55 to the mount port 514. The fitting between the inner thread and the outer thread enables adjustment of a preload force of the valve stem spring 54. As such, the fitting between the inner and outer threads can significantly facilitate the connection and fixation between the lock cap and the mount port. Meanwhile, the fitting between the inner and outer threads may facilitate adjustment of the lock cap so as to realize adjustment of the spring preload force of the valve stem spring, thereby facilitating control of the pressure upon pressure relief.

To facilitate the fitting between the valve body and the gas outlet passage and to guarantee sealing performance, a mount slot 414 may be provided on the gas outlet passage 41 at an outer periphery of the gas exhaust port 411, and the valve port 512 is in sealing-fit with the mount slot 414. Specifically, a sealing ring 415 is provided between an outer sidewall of the valve port 512 and an inner sidewall of the mount slot 414 to achieve the sealing-fit. More specifically, a ring-shaped groove may be provided on a sidewall of an outer perimeter of the valve port 512, and the sealing ring 415 is mounted in the ring-shaped groove for installation and fixation of the sealing ring 415. This not only facilitates the connection between the valve body and the gas outlet passage, but also may ensure non-leakage of the gas, thereby guaranteeing the pressure relief effect.

It may be understood that the pressure port and the pressure relief port may be arranged in a same side, which may also facilitate pushing against the valve stem and meanwhile guarantees the pressure relief effect.

It may be understood that the gas tube may also be a metal tube or a plastic tube, etc.

It may be understood that the gas bleed hole may be arranged on a sidewall of the valve body above the valve stem, which may well guarantee normal exhaust of the gas entering above the valve stem, thereby guaranteeing that the valve ball can be pushed open normally.

It may be understood that the gas bleed hole may also be implemented by arranging a diaphragm leaf above the valve stem.

Besides the preferred embodiments above, the present disclosure also has other embodiments. Those skilled in the art may make various variations and alternations based on the present disclosure, and such variations and alterations should fall within the scope defined by the appended claims without departing from the spirit of the present disclosure.

What is claimed is:

1. A spray gun, comprising:

a machine body, a gun body, and a spray cup, wherein a motor is provided in the machine body for supplying a gas to the gun body, a gas outlet passage is provided on the motor, a gas exhaust port and a gas intake port which communicates with the gun body are provided on the gas outlet passage, a pressure relief valve is provided at the gas exhaust port, the pressure relief valve comprises a valve body having a valve cavity, a valve port, a pressure relief port and a mount port communicating with the valve cavity are provided on the valve body, a valve stem and a valve ball rotatable axially along the valve cavity are provided in the valve cavity; a valve stem spring is provided in the valve cavity for pushing the valve stem to control the valve ball to open and close the gas exhaust port; the valve port is docked to the gas exhaust port; a lock cap for axially retaining the valve stem spring is provided at the mount port; the pressure relief valve further comprises a gas bleed hole communicating with the valve cavity; a gas outlet port is provided on the gas outlet passage; a pressure port in communication with the valve cavity is provided on the valve body, and the gas outlet port is arranged in communication with the pressure port, wherein when the gun body is closed, one part of the gas pushes the valve ball open via the gas exhaust port, the other part of the gas enters the valve cavity sequentially via the gas outlet port and the pressure port.

2. The spray gun according to claim 1, wherein the valve port and the mount port are arranged along a central axis of the valve body, and the pressure port and the pressure relief port are disposed on a sidewall of the valve body.

3. The spray gun according to claim 2, wherein the pressure port is disposed above the pressure relief port.

4. The spray gun according to claim 3, wherein the pressure port is arranged opposite to the pressure relief port; or, the pressure port and the pressure relief port are arranged at a same side.

5. The spray gun according to claim 2, wherein the pressure relief port is arranged on the sidewall of the valve body proximal to the valve port.

6. The spray gun according to claim 1, wherein the gas bleed hole is arranged on the lock cap; or, the gas bleed hole is arranged on a sidewall of the valve body above the valve stem.

7. The spray gun according to claim 1, wherein a retaining ring for radially retaining the valve stem is provided in the valve cavity.

8. The spray gun according to claim 1, wherein a collar is provided on the valve stem, one end of the valve stem spring abuts against the collar, and the other end of the valve stem spring abuts against the lock cap.

9. The spray gun according to claim 1, wherein the lock cap is provided with an outer thread, and an inner sidewall of the mount port is provided with an inner thread; the outer thread is fitted with the inner thread to fix the lock cap to the mount port; and fitting between the inner thread and the outer thread enables adjustment of a preload force of the valve stem spring.

10. The spray gun according to claim 1, wherein a mount slot is provided on the gas outlet passage at an outer periphery of the gas exhaust port, and the valve port is sealing-fitted with the mount slot.

* * * * *